United States Patent [19]

Okazaki et al.

[11] Patent Number: 5,003,604

[45] Date of Patent: Mar. 26, 1991

[54] VOICE CODING APPARATUS

[75] Inventors: Koji Okazaki; Yasuji Ohta, both of Kawasaki; Fumio Amano, Tokyo; Shigeyuki Unnagami, Atsugi, all of Japan

[73] Assignee: Fujitsu Limited, Kawasaki, Japan

[21] Appl. No.: 321,153

[22] Filed: Mar. 9, 1989

[30] Foreign Application Priority Data

Mar. 14, 1988 [JP] Japan ..... 63-60138
Mar. 14, 1988 [JP] Japan ..... 63-60139

[51] Int. Cl.[5] ..... G10L 5/00
[52] U.S. Cl. ..... 381/49; 381/38
[58] Field of Search ..... 381/49, 36, 38

[56] References Cited

U.S. PATENT DOCUMENTS 4,776,014 10/1988 Zinser ..... 381/38
4,797,926 1/1989 Bronson et al. ..... 381/36

*Primary Examiner*—Emanuel S. Kemeny

*Attorney, Agent, or Firm*—Staas & Halsey

[57] ABSTRACT

A voice coding apparatus includes a pitch detecting circuit which detects a pitch period of a voice signal; a pitch waveform generating circuit which samples the voice signal for a plurality of pitches based on the pitch period detected by the pitch detecting circuit and which generates a waveform of one pitch from the waveform of the plurality of pitches; a band restriction circuit which restricts the frequency band of the one pitch waveform generated in the pitch waveform generating circuit; and a coding circuit for coding the voice waveform which is band restricted in the band restriction circuit. The sampling number of the waveform for a plurality of pitches and the restricted bandwidth can be changed in accordance with the amount of the pitch period extracted in the pitch detecting circuit. Further, the pitch detecting circuit is able to correctly detect the pitch period even when the pitch period is not a multiple of the sampling period.

5 Claims, 4 Drawing Sheets

VOICE CODING APPARATUS

BACKGROUND OF THE INVENTION

1. Field of the Invention

The present invention relates to a voice coding apparatus used for a high efficiency coding of the voice, etc.

2. Description of the Related Art

In the voice coding apparatus, when the voice signal is coded at a low bit rate, the original voice must be regenerated at the regeneration side without losing its essential nature, when heard.

As one means achieving a high efficiency coding the pitch extraction means described as follows is known. That is, the voice waveform for N pitches is sampled from the voice signal, a voice waveform corresponding to one pitch is formed from the voice waveform for these N pitches, and this waveform is coded and transmitted to the receiving side, At the receiving side, the received signal is decoded, and thereafter, is repeated N times, whereby a voice signal for N pitches is generated. Accordingly, transmission bit rate can be reduced by 1/N, compared with the case when the whole voice waveform is transmitted.

In another known means for achieving a high efficiency coding, the band of the voice signal is restricted, to decrease the sampling frequency, and thus the low bit rate is realized. Namely, the band of the voice signal is decreased to 1/M, and is down sampled by a 1/M sampling frequency, whereby the transmission bit rate is decreased to 1/M, compared to the case where the band is not restricted.

The first pitch extracting method for forming a waveform of one pitch from the waveform of a plurality of pitches is disadvantageous in that the coding delay $\tau$ becomes too long when the voice frequency is low. Namely, when the pitch period is designated as T, and the number of sampled waveforms of the original waveform for the plurality of pitch waveforms which extracts the waveform of one pitch is N, the coding delay $\tau$ in the transmission side usually becomes $$\tau = 2N \cdot T$$

Assuming that the maximum value $T_{max}$ of the pitch period is 20 msec and the number of sampled waveforms is N=6, the maximum coding delay $\tau_{max}$ becomes 240 msec, and this delay causes practical problems in communication. Therefore, the amount of the number of the sampled waveforms N is restricted by the maximum pitch period, but in this case a sufficiently low bit rate cannot be realized.

The second method for restricting the band of the voice signal is disadvantageous in that, when the band restricted voice signal is regenerated at the receiving side, the voice signal is not clear when heard.

Further, in such a voice coding apparatus, to increase the efficiency, an estimate of a pitch period of the voice is sometimes required, and various pitch extraction methods have been proposed for thus purpose.

When the signal is formed by repeating the same waveforms as a voice signal, if the pitch period thereof is assumed to be T, the periods 2T, 3T, 4T, . . . which are multiple of T, also have one period. Accordingly, these multiple pitch periods may be incorrectly detected as voice pitch periods. Especially, such an incorrect extraction may occur when the pitch period T is not a multiple of the sampling period.

To avoid such an incorrect extraction of the pitch period, when the pitch period is a multiple of the sampling period, a true pitch period T is detected as follows. First, the virtual pitch period T(d) is detected, and to detect that this pitch period T(d) is a time of the true pitch period T, it is determined whether or not the period function of one by integer numbers of the pitch period T(d) exists by using an auto-correction function, etc., whereby T(d)/T is determined and the true pitch period T can be extracted.

On the other hand, when the pitch period is not multiple of the sampling period, the above-mentioned method can not be used, and a method of determining a multiple pitch number T(d)/T is not known.

SUMMARY OF THE INVENTION

An object of the present invention, while using the pitch extraction method and the band restriction method, is to reduce the transmission bit rate, and to provide a voice coding apparatus which suppresses any increase of the coding delay and the deterioration of the regenerated voice.

Another object of the present invention is to provide a pitch extraction apparatus which can correctly detect the pitch period, even when the pitch period is not a multiple of the sampling period.

In accordance with the present invention, there is provided a voice coding apparatus which comprises a pitch detecting means for detecting a pitch period of a voice signal; a pitch waveform generating means for sampling the voice signal for a plurality of pitches based on the pitch period detected by the pitch detecting means, and for generating a waveform of one pitch from the waveform of the plurality of pitches; a band restriction means for restricting the frequency band of the one pitch waveform generated in the pitch waveform generating means; and a coding means for coding the voice waveform which is band restricted in the band restriction means; whereby, in accordance with the amount of the pitch period extracted in the pitch detecting means, changing the sampling number of the waveform for a plurality of pitches in the pitch waveform generating means and the restricted band width due to the band restriction means.

Further, in the present invention, the pitch detecting means comprises a pitch extraction means for extracting a virtual pitch period of the input signal, a discrete Fourier transformation means for carrying out a discrete Fourier transformation of the input signal using the pitch period extracted in the pitch extraction means as a frame; and a multiple pitch detecting means for detecting whether or not an amplitude at each frequency point has a linear spectrum obtained by a discrete transformation at the discrete Fourier transformation means, and in accordance with the detecting result, detecting a number of multiple pitches so as to detect a true pitch period (T) of the input signal.

BRIEF DESCRIPTION OF THE DRAWINGS

Embodiments of a voice coding apparatus according to the present invention will now be described with reference to the accompanying drawings, in which.

DESCRIPTION OF THE PREFERRED EMBODIMENTS

Figure 1:
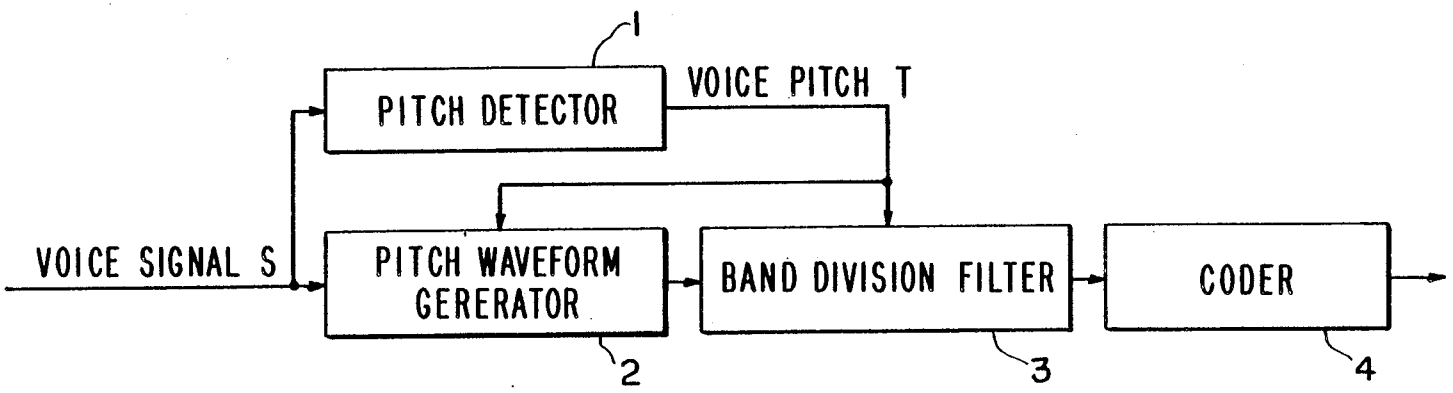
FIG. 1 is a diagram explaining the principle of the present invention.

FIG. 1 is a block diagram explaining the principle of the voice coding apparatus according to the present invention.

The voice coding apparatus shown in FIG. 1 provides a pitch detecting means 1 which detects the pitch period T of the voice signal, a pitch waveform generator 2 which samples the voice signal for a plurality of pitches based on the pitch period detected by the pitch detector 1, and generates a waveform of one pitch from the waveform of the plurality of pitches, a band division filter 3 which restricts the frequency band of the one pitch waveform generated in the pitch waveform generator 2 to 1/M, and a coding means 4 for coding the voice waveform which is band restricted in the band division filter 3, whereby the voice signal is formed in accordance with the amount of pitch period detected in the pitch detecting means 1, the sampling number N of the pitch waveform in the pitch waveform generator 2, and the restricted band ratio M produced by the band division filter 3.

Usually, the pitch period of a human voice is higher than 80 Hz, but sometimes becomes lower due to intonation. Therefore, a voice having long pitch period T in which the coding delay $\tau$ becomes a problem usually appears when the intonation is low. For such a low voice intonation, even if the frequency band is restricted in the transmission side the regenerated voice signal at the receiving side is unchanged, and therefore, the affect due to the band restriction is practically small.

Therefore, although this hearing characteristic is used to decrease the coding bit rate, the coding delay is shortened and the voice coding is carried out without deterioration. That is, although the sampling number N of the pitch waveform is reduced in the pitch waveform generator 2 for a voice signal having a long pitch period T, to prevent an increase in the coding delay $\tau$, the increase of the bit rate due to the reduction of the sampling number N of the pitch waveform is canceled by restricting the band of the voice waveform to 1/M in the band division filter 3 to lower the bit rate to 1/M. Even if the band is so restricted, since the voice signal has a long pitch period, the affect due to the band restriction in the regenerated side can be ignored.

For a voice signal having a short pitch period T, although the sampling number N of the pitch waveform is increased in the pitch waveform generator 2, to lower the bit rate, the degree of band restriction in the band division filter 3 is lessened to prevent a deterioration of the regenerated voice signal.

As explained above, in the present invention, the sampling number N of the pitch waveform and the band restriction rate 1/M are controlled in accordance with the pitch period T, and therefore, when T is large the sampling number N of the pitch waveform is made small, to reduce the coding delay $\tau$, but instead M is made large to maintain the coding compression constantly at a ratio of $1/L=1/NM$ and the quality of the regenerated voice signal is equivalent, when heard, to that when the band restriction is not carried out.

For example, when the sampling number N and the band restriction rate 1/M is changed in accordance with the pitch period T in such a manner that, when the pitch period T=0–12.5 msec, the sampling number N=6 and the band restriction ratio 1/M=1, and alternatively, when the pitch period T=12.5–20 msec, the sampling number N=3 and the band restriction ratio $1/M=\frac{1}{2}$, in the former case the maximum value $\tau_{max}$ of the coding delay becomes $2\times12.5\times6=150$ msec, and in the latter case the maximum value $\tau_{max}$ of the coding delay becomes $2\times20\times3=120$ msec. Subsequently, the coding delay is 150 msec at maximum, and thus does not cause a problem in practice.

Figure 2:
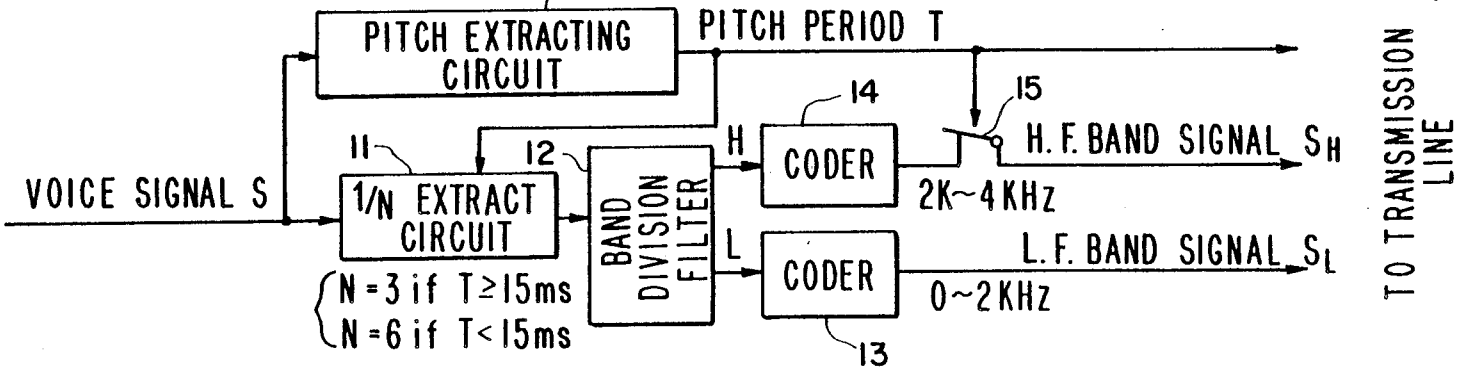
FIG. 2 is a block diagram of the coding portion of the embodiment of the present invention.

The coding portion of the embodiment of the present invention is shown in FIG. 2. In FIG. 2, the voice signal S is input to a pitch extraction circuit 10 and a 1/N extraction circuit 11. The pitch extraction circuit 10 extracts a pitch period of an input voice waveform, and the extracted pitch period T is supplied to the 1/N extraction circuit 11 and a switching circuit 15, and further to a decoding portion via a transmission circuit.

The 1/N extraction circuit 11 forms a voice waveform of one pitch from the input voice waveform including N pitches. When the pitch period T extracted in the pitch extraction circuit 10 is more than 15 msec, one pitch waveform is formed by the voice waveform of N=3, i.e., 3 pitches, and when the pitch period $T<15$ msec, one pitch waveform is formed by the voice waveform of N=6, i.e., 6 pitches.

One pitch waveform generated in the 1/N extraction circuit 11 is then supplied to a band division filter 12. The band division filter 12 divides the input voice signal S having a bandwidth of 0–4 kHz into a low frequency band signal $S_L$ of 0–2 kHz and a high frequency band signal $S_H$ of 2 kHz–4 kHz, and these signals are supplied to coders 13 and 14, respectively, and coded therein. Then the low frequency band signal $S_L$ and high frequency band signal $S_H$ are down sampled to $\frac{1}{2}$ of the sampling signal of an original voice signal.

The low frequency band signal $S_L$ from the coder 13 is directly transmitted to a transmission line and the high frequency band signal $S_H$ from the coder 14 is supplied via the switching circuit 15 also to the transmission line. The switching circuit 15 receives the pitch period T information from the pitch extract circuit 10, and when $T<15$ msec, the circuit 15 is closed to send the high frequency band signal $S_H$ of the coder 14 to the transmission line. Alternatively, when $T\geqq15$ msec, the circuit 15 is opened to stop the transmission of the high frequency band signal $S_H$ of the coder 14 to the transmission line.

Accordingly, in this embodiment, the sub-band coding system, i.e., the system in which the input signal is divided into a high frequency band component and a low frequency band component and each band component signal is independently coded, is utilized as the band restriction system in the coding portion. At this time, each band signal is down sampled in accordance with the band width thereof.

Figure 3:
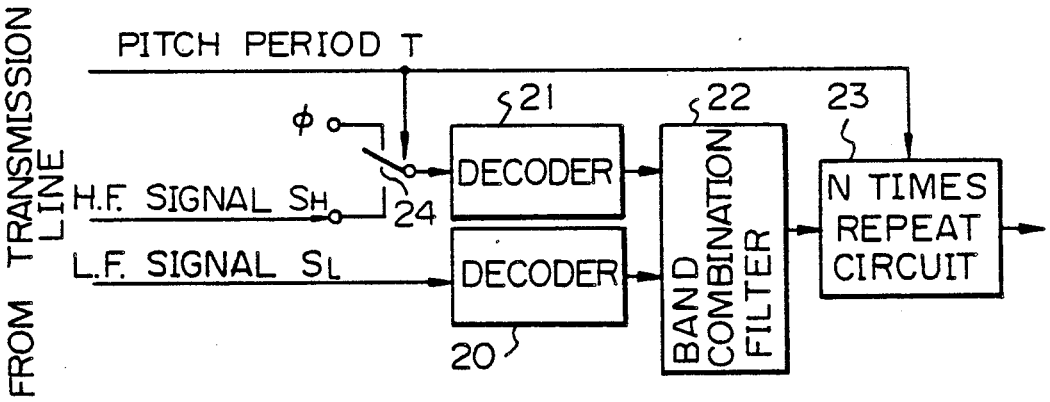
FIG. 3 is a block diagram of the decoding portion of the embodiment of the present invention.

A decoding portion according to the present invention is shown in FIG. 3. In FIG. 3, the low frequency band signal $S_L$ transmitted via the transmission line from the coding portion is input to a decoder 20 and the high frequency band signal $S_H$ is input via a switching circuit 24 to a decoder 21. Further, the pitch period T information is input to the switching circuit 24 and an N time repeat circuit 23. The switching circuit 24 is switched in accordance with the pitch period T. Namely when $T<15$ msec, the circuit 24 is switched to the transmission line side to input the high frequency band signal $S_H$ from the transmission line to the decoder 21. Alternatively, when $T\geqq 15$ msec the circuit 24 is switched to stop the input of the high frequency band signal $S_H$ from the transmission line to the decoder 21.

The signals output from the decoders 20 and 21 are input to a band composite filter 22, and the resultant composite signal is input to the N time repeat circuit 23. The N time repeat circuit 23 repeats the decoded voice waveform from the band composite filter 22 N times in accordance with the pitch period T, to form a regenerated voice signal.

The actual operation of the system is explained as follows. In the coding portion, first the input voice signal S is input to the pitch extraction circuit 10 and the 1/N extraction circuit 11, and the pitch period T of the voice signal S is extracted in the pitch extraction circuit 10. Assuming that the extracted pitch period T is less than 15 msec, i.e., $T<15$ msec, the 1/N extraction circuit 11 samples the input voice signal for 6 pitches and forms one pitch voice waveform from the 6 pitches waveform and outputs same. The one pitch voice waveform from this 1/N extraction circuit 11 is input to the band division filter 12 to be divided into a low frequency band signal $S_L$ and a high frequency band signal $S_H$. These signals $S_L$ and $S_H$ are coded in the coders 13 and 14, i.e., are down sampled to $\frac{1}{2}$. Since the pitch period T is $T<15$ msec the switching circuit 15 is closed, and thus the low frequency band signal $S_L$ and the high frequency band signal $S_H$ from the decoders 14 and 15 are transmitted via the transmission line to the decoding portion.

Alternatively, when the pitch period T extracted in the pitch extraction circuit 10 is $T\geqq 15$ msec, the 1/N extraction circuit samples the voice signal S for three pitches, so that one pitch of a voice signal is generated from the three pitches of the voice waveform. This voice waveform is divided into the low frequency signal $S_L$ and the high frequency signal $S_H$ in the same way as described above, and are coded in the coders 13 and 14. But, if in $T\geqq 15$ msec, the switching circuit 15 is opened, and the high frequency signal $S_H$ from the decoder 14 is not transmitted to the transmission line.

Accordingly, when the pitch period T is $T\geqq 15$ msec, the sampling number N of the pitch waveform in the 1/N extraction circuit 11 is made one-half of the case when $T<15$ msec, and thus the coding compression ratio in the 1/N extraction circuit is reduced by one-half. Nevertheless, only the low frequency band signal $S_L$ divided in the band division filter 12 from the voice signal S is supplied to the decoding portion, and therefore, the bit rate can be lowered by one-half, and thus the coding compression ratio of the signal output to the transmission line is made the same as when the pitch period T is $T<15$ msec. Namely, if the sampling number of the pitch waveform is N and the band is restricted to 1/M by sampling down to 1/M, the compression ratio $1/L=1/(N.M)$ is always constant regardless of the pitch period T.

In the decoding portion, when $T<15$ msec, the switching circuit 24 is connected to the transmission line side and the low frequency band signal $S_L$ and the high frequency band signal $S_H$ are transmitted via the transmission line and are input to the decoders 20 and 21 and decoded. These signals are then composited in the band composite filter 22 and the composite signal is input to the N times repeat circuit 23. The N times repeat circuit 23 repeats this composite signal waveform 6 times, to generate a regenerated signal.

When $T\geqq 15$ msec, only the low frequency band signal $S_L$ from the transmission line is decoded in the decoder 20, is repeated N times via the band composite filter 22 and input to the circuit 23, and in the N times repeat circuit 23, the composite signal waveform is repeated 3 times, to generate a regenerated signal.

When the signal is formed by repeating the same waveforms as a voice signal, if the pitch period thereof is assumed to be T, the periods 2T, 3T, 4T, . . . , which are multiple of T, also have one period, and accordingly, these multiple pitch periods may be incorrectly detected as voice pitch periods. Especially, such an incorrect extraction may occur when the pitch period T is not a multiple of the sampling period.

Figure 4:
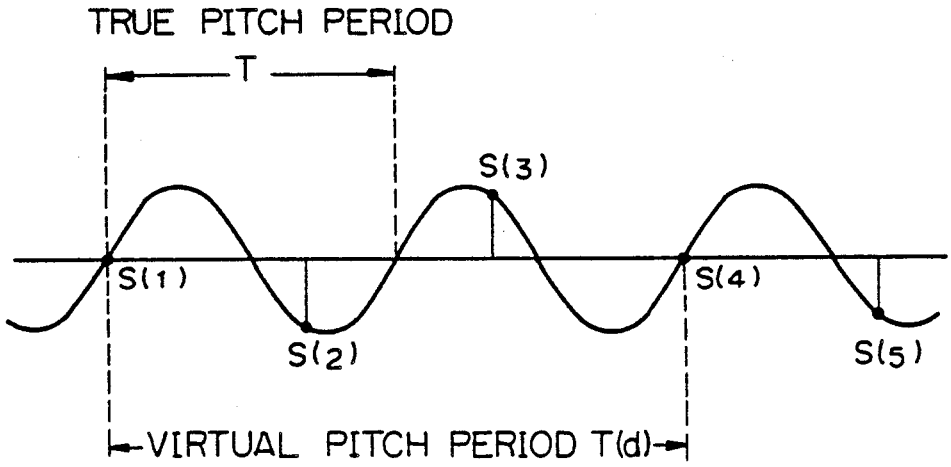
FIG. 4 is a diagram for explaining the problem of the known pitch extraction method.

FIG. 4 is a diagram explaining such an incorrect extraction, and shows the case when the pitch period T of a period waveform is 1.5 times the sampling period. In the drawing, the waveform shown by a solid line is a period waveform and S(1)–S(5) are sampling points. The actual pitch period of this period waveform is T, as shown in the drawing, but when the pitch period is extracted as the frame from 0 point to 0 point of the period waveform, in the example of FIG. 4, the sampling points at which the sampling values of both ends become 0 are S(1) and S(4), and thus the frame S(1)–S(4) may be incorrectly detected as a pitch period. In this case, the pitch period T(d) is 3x sampling period, and becomes twice the true pitch period T.

To avoid this incorrect extraction of the pitch period, when the pitch period is a multiple of the sampling period, a true pitch period T is detected as follows. First, the virtual pitch period T(d) is detected. To detecting the times of this pitch period T(d) with regard to the true pitch period T, it is determined whether or not the period function of one by an integer number of pitch periods T(d) exists, by using an auto-correlation function, etc., whereby T(d)/T is determined and the true pitch period T can be extracted.

Alternatively, when the pitch period is not a multiple of the sampling period, the above-mentioned method can not be used, and a method of determining the multiple pitch number T(d)/T was not known until now.

Figure 5:
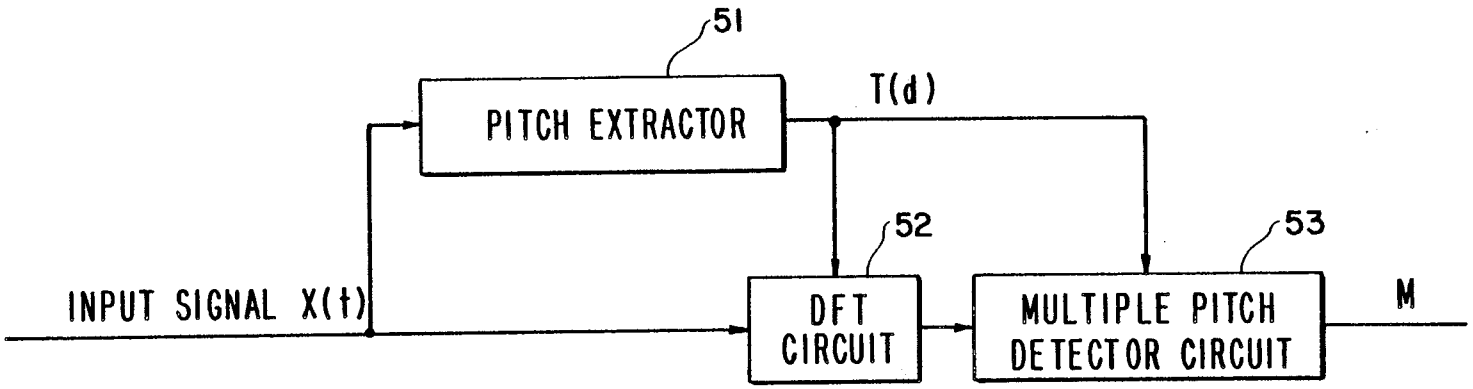
FIG. 5 is a block diagram of the pitch extraction circuit according to the present invention.

FIG. 5 is a principle block diagram of a pitch extracting circuit which correctly detects the pitch period even when the pitch period is not a multiple of the sampling period. The pitch extraction circuit shown in FIG. 5 extracts a pitch period T of an input signal x(t) sampled sequentially at a discrete time, and comprises a pitch extractor 51 for extracting a virtual pitch period T(d) of the input signal, a discrete Fourier transformation circuit 52 for carrying out a discrete Fourier transformation of the input signal using the pitch period T(d) extracted in the pitch extractor 51 as a frame length; and a multiple pitch detector 53 for detecting whether or not an amplitude at each frequency point is a linear spectrum obtained by a discrete transformation at the discrete Fourier transformation circuit 52 and thus, in accordance with the detection result, detects the number of multiple pitches to thereby detect a true pitch period T of the input signal.

In FIG. 5, first the pitch is extracted for the input signal x(t) in the pitch extractor 10 by a conventional pitch extraction method. The extracted pitch period T(d) is a virtual pitch and can be n times the pitch of a true pitch period T. Therefore, to determine a multiple times pitch number n=T(d)/T, a T(d) point DFT (discrete Fourier Transformation) is carried out for the input signal x(t), using the pitch period T(d) as the frame length.

As a result of this T(d) point DFT, the following spectrum is obtained.

$$\tilde{x}(k) = \sum_{t=0}^{T(d)-1} x(t) \exp\left(i \frac{2\pi}{T(d)} kt\right) \quad (1)$$

wherein $\tilde{x}(k)$ is an amplitude of a linear spectrum at a frequency $kf_0/T(d)$, $f_0$ is a sampling frequency, and $k=0, \pm 1, \pm 2, \ldots$.

Usually, when the multiple pitch number T(d)/T=n, in the line spectrum $\tilde{x}(k)$ obtained by T(d) point discrete Fourier transformation of the input signal x(i), the line spectrum at each frequency 0 Hz, $\pm nf_0/T(d)$, $\pm 2nf_0/T(d)$, $\pm 3nf_0/T(d)$ . . . is not made 0, but the other frequency spectrums other than these are made zero.

Figure 6:
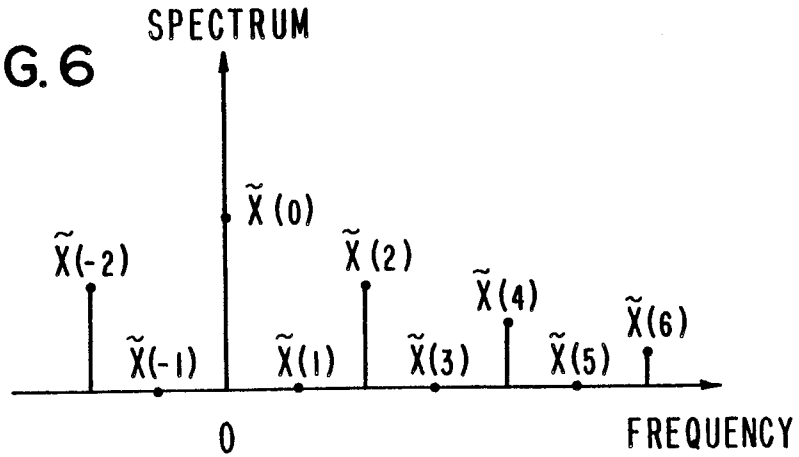
FIG. 6 is a diagram explaining the line spectrum after discrete Fourier transformation.

For example, when the multiple pitch number n=2, as shown in FIG. 6, the line spectrums $\tilde{x}(\pm 1)$, $\tilde{x}(\pm 3)$, $\tilde{x}(\pm 5)$, . . . are respectively zero, but the line spectrums $\tilde{x}(0)$, $\tilde{x}(\pm 2)$, $\tilde{x}(\pm 4)$, . . . have a finite value, respectively. Similarly, when the multiple pitch number n=3, the line spectra $\tilde{x}(\pm 1)$, $\tilde{x}(\pm 2)$, $\tilde{x}(\pm 4)$, $(\pm 5)$, . . . are zero, respectively, and the line spectra $\tilde{x}(0)$ $\tilde{x}(\pm 3)$, $\tilde{x}(\pm 6)$, . . . have a finite value, respectively. Therefore, when the states of these spectra are detected, the times of the pitch period T(d]extracted in the pitch extractor 10 to the true pitch period can be obtained.

As the method for determining the multiple pitch number n from the line spectrum, the following method can be used. Namely, as $\tilde{x}(k)$ has a finite value when k is 0, $\pm n$, $\pm 2n$, $\pm 3n$, . . . and has a zero value when k is another value, the following equations are satisfied:

$$\sum_{k=0, \pm n, \pm 2n, \ldots} |x(k)|^2 = \text{positive finite value} \quad (2)$$

$$\sum_{k=0, \pm n, \pm 2n, \ldots} |x(k)|^2 = 0 \quad (3)$$

When the multiple pitch number n is assumed to be m times the following value of $\rho(m)$ can be obtained.

$$\rho(m) = \sum_{k \neq 0, \pm m, \pm 2m, \ldots k < \frac{T(d)-1}{2}} |x(k)|^2 / \sum_{k=0, \pm m, \pm 2m, \ldots k < \frac{T(d)-1}{2}} |x(k)|^2 \quad (4)$$

$$\rho(m) = \sum_{k \neq 0, \pm m, \pm 2m} |x(k)|^2 / \sum_{k=0, \pm m, \pm 2m} |x(k)|^2 \quad (4)$$

When in practice n=m, the denominator of $\rho(m)$ becomes a positive number and a numerator thereof becomes zero, and thus $\rho(m)=0$. This $\rho(m)$ is determined in order for m=2, 3, 4, . . . , is repeated, and is stopped when the value m is an adequate number, for example, 10. Among the $\rho(m)$ values determined as above, a maximum m for $\rho(m)=0$ is determined, and this m is taken as the multiple pitch number.

The reason why the maximum m for $\rho(m)=0$ is taken as the multiple pitch number, is explained as follows. For example, when the multiple pitch number n=2, $\rho(2)$ becomes zero, and $\rho(3)$, $\rho(4)$, . . . are all a positive number, whereas when the multiple pitch number n=6, $\rho(2)$, $\rho(3)$, $\rho(6)$ are all zero and $\rho(7)$ and onward are a positive number, whereby the value 6, which is the maximum value for obtaining $\rho(m)=0$, is determined to be the multiple pitch number.

Figure 7:
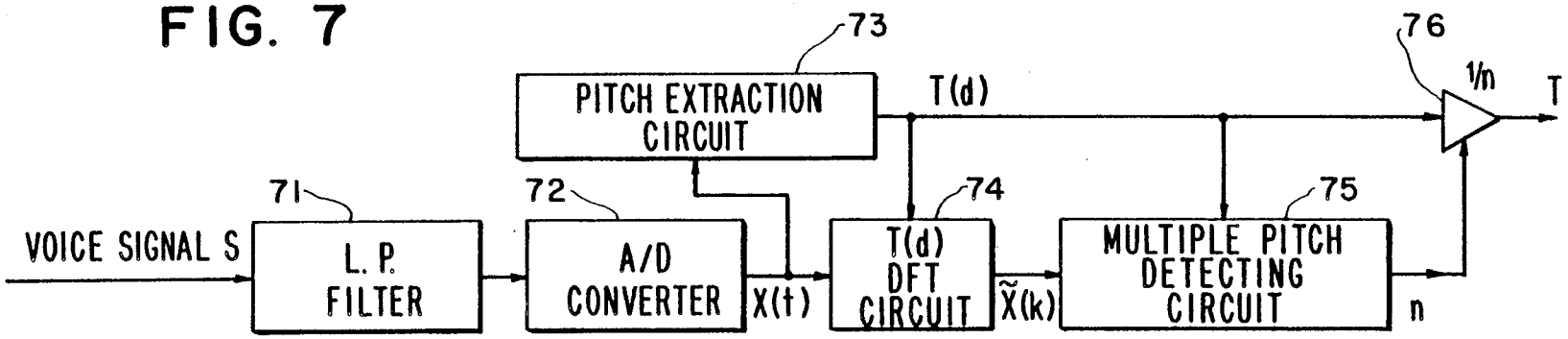
FIG. 7 is a block diagram of the pitch extraction apparatus as one embodiment of the present invention.

Hereinafter, the operation of the circuit shown in FIG. 5 will be explained with reference to FIG. 7. In FIG. 7, a voice signal input from a microphone, etc., is band compressed to 0–4 kHz, via a low pass filter 71, sampled at a sampling frequency of 8 kHz by an A/D converter 72, and transformed to a PCM input signal sequence x(t).

Next, this input signal sequence x(t) is input to a pitch extraction circuit 73 and T(d) point DFT circuit 74, respectively. The pitch extraction circuit 73 detects the pitch of the input signal x(t) in a conventional manner. Various methods of extracting the pitch period T(d), are known, any thereof can be used. For example, a method of determining T(d) is known in which $$h_T(d) = \sum_{t=0}^{L} \{x(t) - x(t - T(d))\}^2$$

becomes the minimum. The pitch period T(d) extracted in such a manner may be a multiple (=n) of the pitch period T. The extracted pitch period T(d) is output to the T(d) point DFT circuit 74 and the multiple pitch detection circuit 75.

In the T(d) point DFT circuit 74, a T(d) point DFT is carried out for the input signal sequence x(t), using the pitch period T(d) detected in the pitch extraction circuit 73 as the frame length and the following line spectrum x(k) is obtained, $$x(k) = \sum_{t=0}^{T(d)-1} x(t) \exp\left(i \frac{2\pi}{t(d)} kt\right)$$

$$\text{wherein } K = -\frac{T(d)-1}{2} \sim +\frac{T(d)-1}{2}$$

This line spectrum $\tilde{x}(k)$ is then input to a multiple pitch detection circuit 75.

In the multiple pitch detection circuit 75, the multiple pitch number n is assumed to be m, and the following $\rho(m)$ is determined for m=2, 3, 4, . . . 10.

For a completely periodic and noiseless voice signal, when T(d)/T=n>1, $\rho(m)$ becomes zero. But, in practice, the noise, etc., is taken into consideration, a small positive number $\epsilon$ is used, and the maximum m for $\rho(m) \leqq 68$ is determined as the multiple pitch number n, and this n is output. The true pitch period T is determined by T=T(d)/n.

Figure 8:
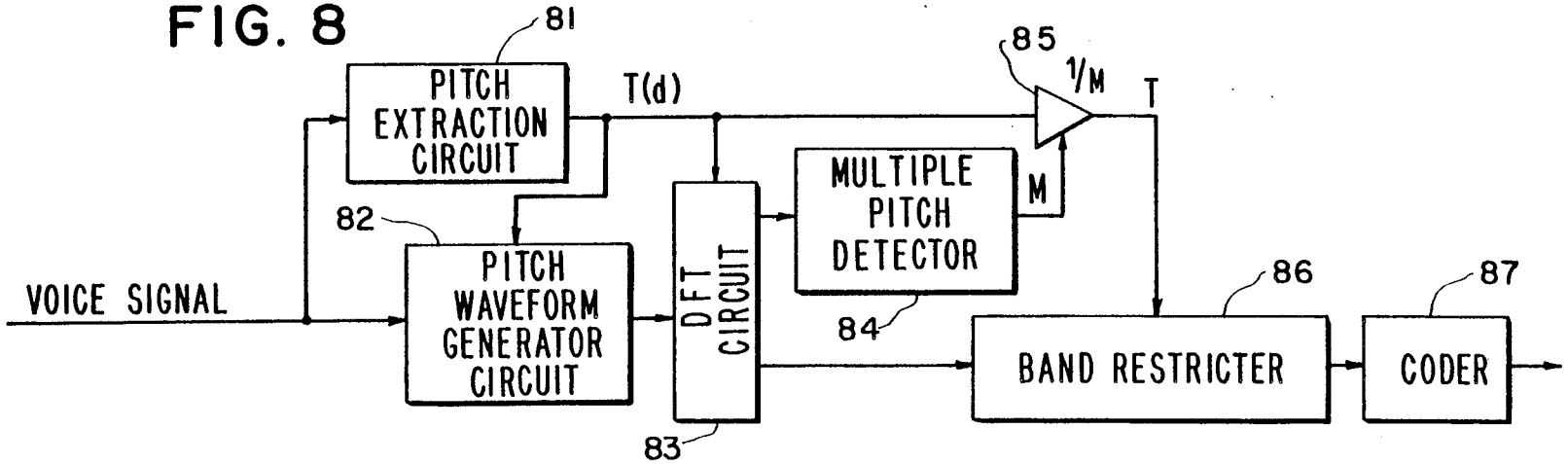
FIG. 8 is another embodiment of the voice coding apparatus according to the present invention.

FIG. 8 shows another embodiment of the present invention utilizing the pitch extraction circuit shown in FIG. 5.

In FIG. 8, the input voice signal is supplied to the pitch extraction circuit 81, which corresponds to the circuit 51 shown in FIG. 5, and is further supplied to a pitch waveform generator 82, which corresponds to the circuit shown in FIG. 1. The output T(d) of the pitch extraction circuit 81 is supplied to the pitch waveform generating circuit 82 and the output of the pitch waveform generator 82 is supplied, together with the pitch extraction circuit 81, to a T(d) DFT circuit 83, which corresponds to the circuit 52 shown in FIG. 5. The output of the T(d) DFT circuit 83 is supplied via a multiple pitch detector 84, which corresponds to the circuit 75, to a divider 85 to determine the pitch period T. The output of the T(d) DFT circuit 83 is also supplied to a band restrictor 86, which corresponds to the circuit 3 shown in FIG. 1, to which the pitch period T is supplied from the divider 85. The output of the band restrictor 86 is coded in a coder 87, which corresponds the circuit 4 shown in FIG. 1, and output to the transmission line.

Various modifications of the embodiments of the present invention, are possible. For example, when arranging the circuit, in addition to the hardware circuit, the object of the present invention can be achieved by using a computer program.

We claim:

1. A voice coding apparatus comprising:

pitch detecting means for detecting a pitch period T of a voice signal;

pitch waveform generating means for sampling the voice signal based on the pitch period T and for generating a pitch voice waveform responsive to said sampling;

band restriction means for restricting the frequency band of the pitch voice waveform based on the pitch period T; and coding means for coding the band restricted pitch voice waveform;

thereby changing, in accordance with the amount of the pitch period extracted in said pitch detecting means the sampling of said pitch voice waveform generating means and the frequency band of the band restricted pitch voice waveform.

2. A voice coding apparatus according to claim 1, wherein said pitch waveform generating means includes:

a first input terminal connectable to receive the voice signal;

a second input terminal operatively connected to receive the pitch period T;

means for, when the pitch period T is longer than 15 msec, providing the pitch voice waveform based on sampling the voice signal using a factor of three; and means for, when the pitch period is shorter than 15 msec, providing the pitch voice waveform based on sampling the voice waveform using a factor of seven.

3. A voice coding apparatus according to claim 1, wherein said band restriction means comprises:

band division filter for dividing the output of said pitch waveform generating means into a high frequency pitch voice waveform and a low frequency pitch voice waveform, and wherein said coding means comprises:

first encoder means for coding the low frequency pitch voice waveform;

second encoder means for coding the high frequency pitch voice waveform;

switch means, operatively connected to said second encoder means and to receive the pitch period T information, for providing the high frequency pitch voice waveform when $T < 15$ msec.

4. A voice coding apparatus according to claim 1, wherein said pitch detecting means comprises:

pitch extraction means for extracting a virtual pitch period (T(d)) of the voice signal;

discrete Fourier transformation means for performing a discrete Fourier transformation on the voice signal using the pitch period (T(d)) as a frame length; and multiple pitch detecting means for determining if the discrete Fourier transformation of the voice signal is a linear spectrum and for detecting a true pitch period (T) of the voice signal based on the determination.

5. A voice coding apparatus comprising pitch extraction means for receiving an input voice signal and for extracting a virtual pitch period (T(d)) of the input voice signal;

pitch waveform generating means for sampling the input voice signal based on the virtual pitch period (T(d)) and for generating a pitch voice waveform using the sampled input voice signal;

discrete Fourier transformation means for performing a discrete Fourier transformation on the voice input signal using the virtual pitch period (T(d)) as a frame length and for providing an output responsive to the discrete Fourier transformation;

multiple pitch detecting means for determining if the discrete Fourier transformation of the voice input signal is a linear spectrum;

divider means for providing a pitch period T based on the virtual pitch period (T(d)) and the determination of said multiple pitch detecting means;

band restricting means for restricting the frequency band of the output of said discrete Fourier transformation means based on the virtual pitch period (T(d)) and for providing a band restricted output; and coding means for coding the band restricted output.

* * * * *

UNITED STATES PATENT AND TRADEMARK OFFICE

CERTIFICATE OF CORRECTION

PATENT NO. : 5,003,604

DATED : March 26, 1991

INVENTOR(S) : OKAZAKI et al.

It is certified that error appears in the above-identified patent and that said Letters Patent is hereby corrected as shown below:

Col. 1, line 4, "Unnagami" should be --Unagami--.

Signed and Sealed this

Third Day of December, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 5,003,604
DATED : March 26, 1991
INVENTOR(S) : Okazaki et al.

It is certified that error appears in the above identified patent and that said Letters Patent is hereby corrected as shown below:

Col. 3, line 54, "canceled" should be --cancelled--.

Col. 7, line 38, "T(d]" should be --T(d)--.

In equation (2), "x" should be --$\tilde{x}$--;

(3), "x" should be --$\tilde{x}$--;

(4), "x" should be --$\tilde{x}$-- (both occurrences).

Col. 8, line 39, "x" should be --$\tilde{x}$--.

In equation (4), "x" should be --$\tilde{x}$-- (both occurrences).

Col. 8, line 63, "68" should be --$\epsilon$--.
Col. 9, line 7, "generating circuit" should be --generator--.

Signed and Sealed this

Third Day of November, 1992

*Attest:*

DOUGLAS B. COMER

*Attesting Officer*

*Acting Commissioner of Patents and Trademarks*